US007651288B2

(12) United States Patent
Welschoff

(10) Patent No.: US 7,651,288 B2
(45) Date of Patent: Jan. 26, 2010

(54) COSMETIC APPLICATOR WITH AXIAL ADVANCE AND RETRACTION CONTROL

(76) Inventor: Heinz Welschoff, 1820 NE. 56th Ct., Fort Lauderdale, FL (US) 33308

( * ) Notice: Subject to any disclaimer, the term of this patent is extended or adjusted under 35 U.S.C. 154(b) by 93 days.

(21) Appl. No.: 11/895,173

(22) Filed: Aug. 22, 2007

(65) Prior Publication Data

US 2009/0052968 A1 Feb. 26, 2009

(51) Int. Cl.
*A46B 11/00* (2006.01)

(52) U.S. Cl. ..... 401/11; 401/75; 401/172

(58) Field of Classification Search ..... 401/11, 401/75, 76, 171, 172, 174; 222/390
See application file for complete search history.

(56) References Cited

U.S. PATENT DOCUMENTS 5,302,042 A 4/1994 Ackermann
5,842,804 A 12/1998 Hurlburt
5,954,441 A 9/1999 Welschoff
6,334,729 B1 * 1/2002 Ohba ..... 401/68
6,896,434 B2 5/2005 Ohba et al.
6,981,811 B2 1/2006 Breidenbach et al.
7,044,673 B2 * 5/2006 Endou ..... 401/205
7,217,054 B2 * 5/2007 Noguchi ..... 401/277
7,309,185 B2 * 12/2007 Thorpe et al. ..... 401/277
2006/0291949 A1 12/2006 Holloway

FOREIGN PATENT DOCUMENTS

JP 06-181813 5/1994

* cited by examiner

*Primary Examiner*—David J Walczak
(74) *Attorney, Agent, or Firm*—Melvin K. Silverman

(57) ABSTRACT

A cosmetic applicator includes an elongate hollow threadable insert having a mouth situated at a front end, an interior, and circumferential splines at an opposite end. An exterior surface of the opposite end of the insert includes an integral partially circumferential cam terminating in a radial edge, the insert having a direction of rotation about an axis of the applicator. A piston having a threaded rod is proportioned in diameter for push-fittable axial insertion through the threadable insert and engagement with a refill cartridge. The rod is proportioned in length to the threadable insert. The refill cartridge receives a stick or column of cosmetic to be applied to the user, and includes a front portion having an annular collar and a portion having a cylindrical internal diameter proportioned for press-fittable receipt of the threaded insert.

10 Claims, 20 Drawing Sheets

108
122
308
302

108/110
119
100
200
204
308
300

108/110
119
100
120
200
122
204

COSMETIC APPLICATOR WITH AXIAL ADVANCE AND RETRACTION CONTROL

FIELD OF THE INVENTION

The present invention relates to system for applying a cosmetic material, such as a lipstick, lipliner or eyeliner. More specifically, disclosed herein is a low cost, hot-filled cosmetic dispenser which forms a novel teardrop shape without a need to swivel the lipstick up and down to control of the axial extent of travel.

BACKGROUND OF THE INVENTION

In a typical prior art lipstick dispenser, there exists a hollow tube and piston which holds the cosmetic material of the lipstick. However, none of the dispensers in the prior art have refill cartridge tubes in the shape of a teardrop or non-cylindrical shape. The inventive teardrop tube shape will re-create the teardrop shape for any type of extrudable cosmetic material used for lipstick. The teardrop shape in the cosmetic industry is important because it creates an appearance on the lips of women that is desired today. It is therefore desirable to provide a mechanical system that can cost-effectively facilitate such a product.

From the economic side, prior art lipstick dispensers have more complicated methods of assembly and are mechanically complex. A traditional lipstick cosmetic assembly is time consuming and otherwise costly to make. The current invention can be assembled and filled with ease and at low cost. Once a production person has the pieces of the dispenser, they can be assembled in less than 10 seconds. Also, the current invention can be used for both full size and slim line types of lipstick in the market today.

Additionally, some dispensers in the prior art waste cosmetic material by using a mechanism which swivels the cosmetic material in the hollow up-and-down tube and piston that contains the lipstick. This causes a bacteria build up and formation of air pockets between the cosmetic material, hollow tube, assembly cap and the piston. As a result the air pockets cause the cosmetic material to break, bend, bend, scrap, shrink or fragment. The current invention also has a locking mechanism which prevents backwards movement of any cosmetic material used. As a result, no air pockets are formed and bacteria build-up around and inside said cosmetic lipstick and hollow tube is prevented.

Another problem with existing eyeliners and lipliner refill dispenser designs lies in placement of a color label on the outside of the refill cartridge, but which is hidden under the cap. As such, consumers cannot see the color of an eyeliner or lipliner, in the store, or after purchase, without first taking off the cap and advancing the cosmetic. This creates confusion when trying to find a certain color of eyeliner or lipliner. The current invention prevents this confusion with a color label on the part of the cartridge of greatest diameter and which is visible without removal of the lipstick cap or advance of said cosmetic.

My U.S. Pat. No. 5,954,441 (1999) discloses a similar body design but is a disposable unit and there is no formation of a teardrop shape in the hollow tube. Also, the patent is meant only for lipsticks having a rectangular cross-section. There also exist material mechanical differences, such as a circumferential multi-position locking system at an end portion of the refill cartridge interacting with the cam on the threadable insert in the current invention.

U.S. Pub. No. 2006/291,949 A1 (2006) to Holloway has an elevator rod and tube that is not in the shape of a teardrop.

Also this design retracts the cosmetic column which causes air pocket formation. There are also mechanical differences including the method of advancing the cosmetic. The current invention uses a multi-position locking system at one end of the refill cartridge in conjunction with a cam on a threadable insert to prevent retraction of the cosmetic material. Also, Holloway teaches a lipstick elevator rod and tube, not a refill system. It locks into the body thereof and, after normal use, is discarded as a complete unit.

U.S. Pat. No. 6,896,434 (2005) to Ohba also has no tear drop shaped tube. Also, it attempts to protect the cosmetic material used in its design but it still advances and retracts the cosmetic material, which is not desirable. The mechanical differences are the same as above and lock a circumferential multi-position locking system and the cam on the threadable insert.

U.S. Pat. No. 5,302,042 (1994) to Ackerman and U.S. Pat. No. 5,842,804 (1998) to Hurlburt have mechanisms to prevent backwards movement of the cosmetic material but there is still no formation of the tear drop shape. The mechanical difference lies in the method of advancement of the cosmetic material. Again, the older inventions do not use multi-position locking in conjunction with a cam on a threadable insert providing a simple (without use of gears or springs) locking mechanism to prevention of backwards movement of the cosmetic material. The Ackerman and Hurlburt locks only to stop the cosmetic from turning back into an hollow tube. After use, the lipstick is turned back in a conventional manner.

U.S. Pat. No. 6,981,811 (2006) to Breidenbach tries to create a teardrop shape but only uses the tip of the lipstick cosmetic, not the entire body thereof. This can cause distortion of the teardrop shape after only a few uses if only the top of the lipstick cosmetic is shaped like a teardrop. The mechanical differences of the invention are the same as above with the inventive multi-position locking system acting in conjunction with the cam on the threadable insert to advance the cosmetic material through the inner teardrop shaped refill cartridge in the current invention.

Based on the deficiencies of the art above, there exists a long felt need for an improved cosmetic dispenser design to overcome the disadvantages mentioned above in addition to providing additional advantages, set forth below.

SUMMARY OF THE INVENTION

A cosmetic applicator comprises an elongate hollow threadable insert having a front situated at a front end thereof and an interior diameter defining, at a proximal end thereof, a circumferential plurality of elongate splines said proximal end upon an exterior surface thereof including a partially circumferential cam comprising a curved incline plane terminating in a radial edge, said threadable insert having a direction of rotation about a longitudinal axis of said applicator; a piston having a threaded rod proportioned in diameter for push-fittable axial insertion through said threadably insert and for threadable engagement therewith, said threaded rod proportioned in length to extend to said elongate female recesses within said interior diameter of said threadable insert and a piston integrally dependent from a front end of said threaded rod; a cartridge for receiving a column of cosmetic to be applied to the user, said cartridge including a front portion having a radial cross-section, an annular collar, and a proximal portion having a cylindrical internal diameter proportioned for press-fittable receipt of said threaded insert, said cam of said proximal end of said threadable insert engaging segmented resilient camming surfaces of said proximal portion and defining a limit of rotation of said cam of said threadable insert relative to said cartridge; and a proximal hollow body proportioned for press-fittable, rotational engagement about said cartridge and, at a proximal end thereof, about a circumferential plurality of elongate splines of said hollow threadable insert. Said front portion of said cartridge may exhibit a substantially ellipsoidal radial cross-section terminating in a front output having a cross-sectional geometry of a teardrop or may exhibit a rectangular cross-section.

The main advantages of this invention are its low cost and speed of assembly, its re-creation of the teardrop shape applicable to any kind of lipstick or linearly extrudable cosmetic and a locking system to prevent backwards movement of the cosmetic material, the hot filled method of filling the cartridge, and its color label on the outside. A lipstick column can be made and inserted into a refill cartridge and locked in place on said piston. Thus to be used as an advance and reduction control system.

From a marketing point of view, the refill cartridge in the invention cannot be used alone, customers will need to purchase a complete unit or else the refill cartridge is unusable. Testers used in stores may be like new and hygienic, environment friendly, less parts and waste. Testers in a store will only require the refill cartridge, not the complete assembly.

The above and yet further objects and advantages of the invention will become apparent from the hereinafter Brief Description of the Drawings, Detailed Description of the Invention, and claims appended herewith.

BRIEF DESCRIPTION OF THE INVENTION

FIG. 25 shows the complete assembly including consumer purchase printing color code at the cross-sectional high point of cartridge and company product color and grams-oz printed on rear, round part of cartridge, showing the metal sleeve over the cap and body, with the end plug press-fit into the body and against the body metal sleeve to hold it without use of glue or the like.

DETAILED DESCRIPTION OF THE INVENTION

Figure 1:
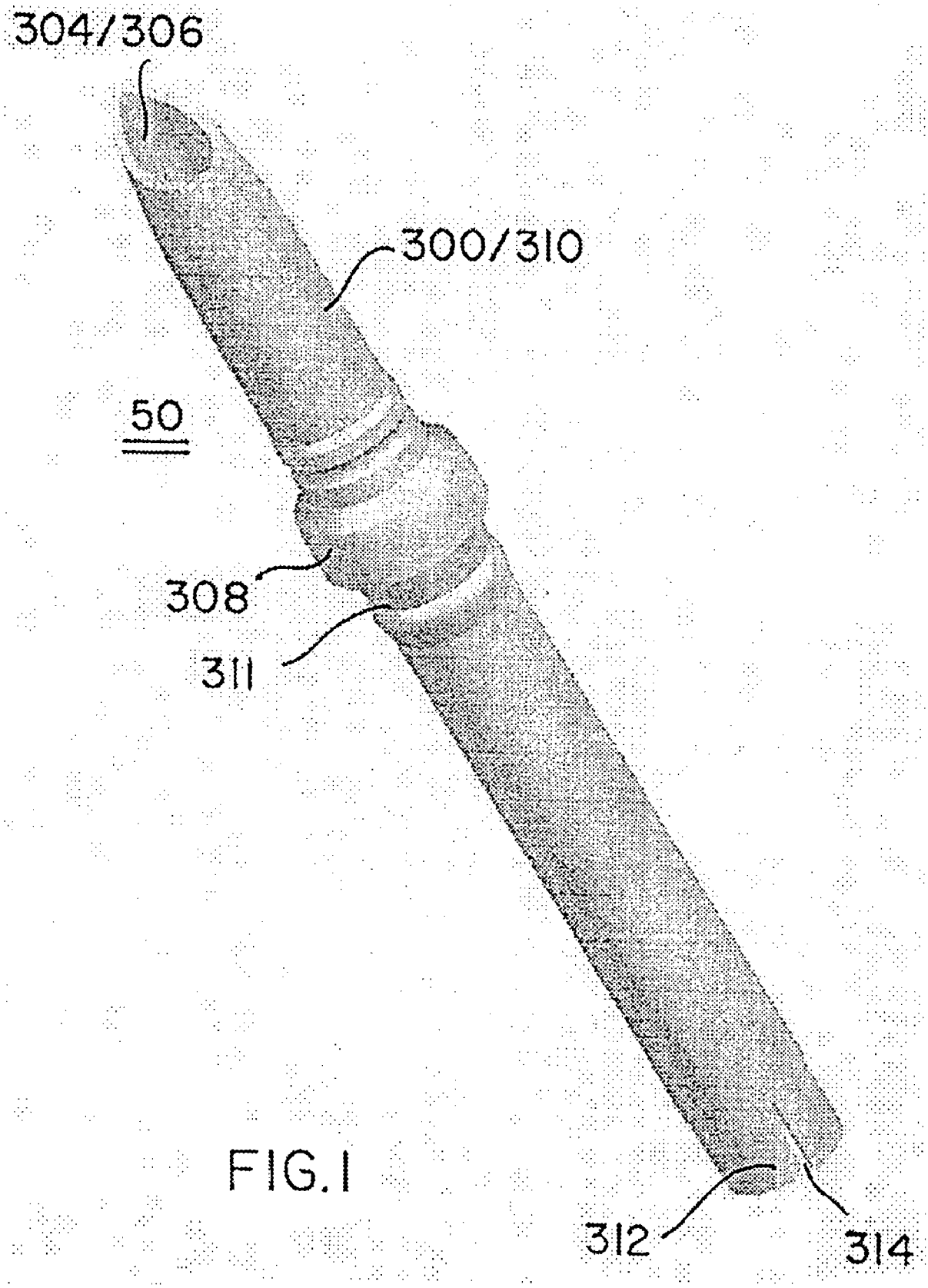
FIG. 1 is a perspective view of the complete cartridge part of the present cosmetic applicator.
Figure 2:
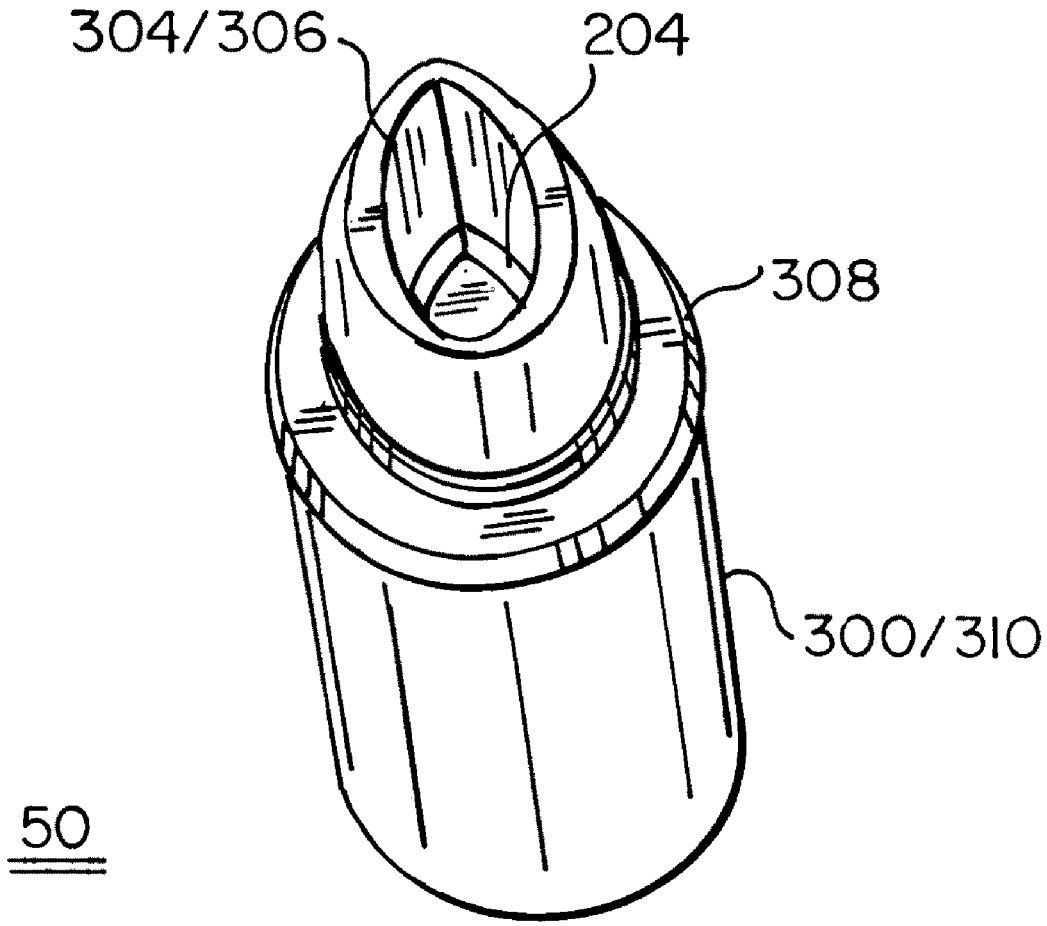
FIG. 2 is a perspective view of the applicator, however taken along a different axial direction than that of FIG. 1.

With reference to the perspective view of FIG. 1, there is shown a front portion 310 of a cartridge 300 as is more fully described below, of the inventive cosmetic applicator 50 FIG. 2 is a further perspective view of the cosmetic applicator 50, however taken from a direction closer to the longitudinal axis of the refill cartridge 300. As may be noted, in FIGS. 1 and 2, a front 304 of said cartridge 300 exhibits a substantially ellipsoidal radial cross-section 306, the same often referred to as a teardrop geometry, as well as an annular collar 308 at which a male lock ring 311 of the teardrop of the cartridge begins.

Figure 3A:
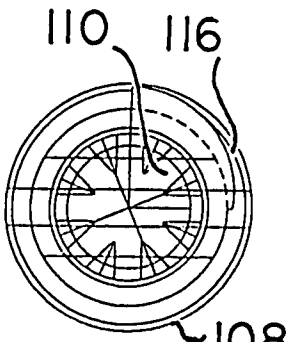
FIG. 3A is a proximal axial end view of FIG. 3.
Figure 3:
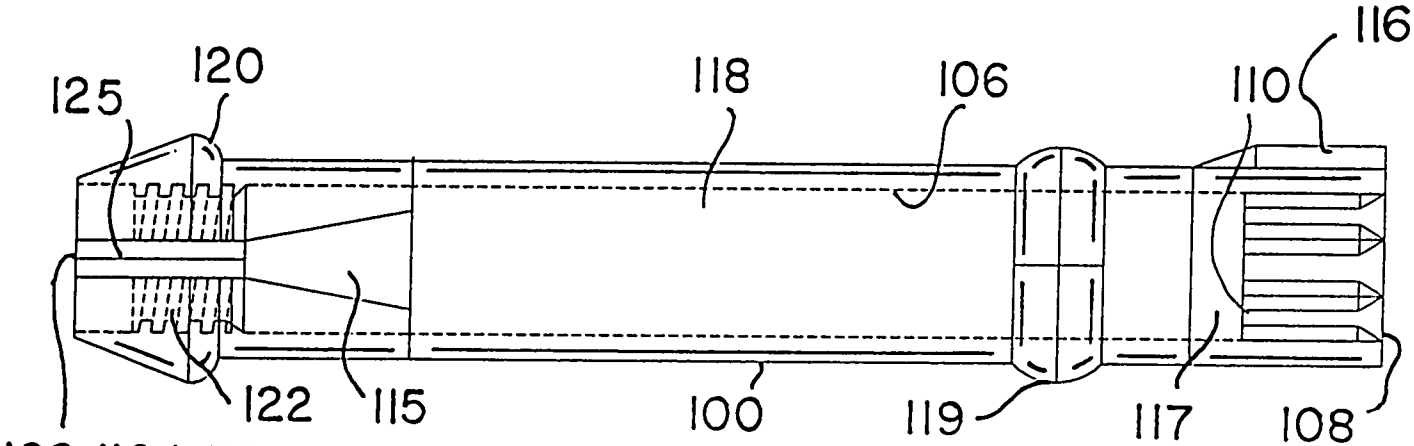
FIG. 3 is an axial cross-sectional view of the hollow threadable insert of the invention.

In FIG. 3 is shown a longitudinal diametric cross-sectional view of a hollow threaded insert 100 having a guide opening or mouth 102 at a front end 104 of insert 100, and an interior diameter 106 defining, at a proximal end 108 thereof, a circumferential plurality of splines formed within said interior diameter 106. Proximal end 108 also includes an integral exterior partially circumferential curved cam 116, more fully described below. FIG. 3A is an axial view thereof. Also shown are annular rings 119 and 120. Just proximally of mouth 102 is an interior threaded surface 122. A large V-shaped opening 115 of threaded insert 100 affords flexibility at the mouth of insert 100 and appropriate mutual friction when placed inside of cartridge 300. See FIGS. 6 and 9A.

Figure 4:
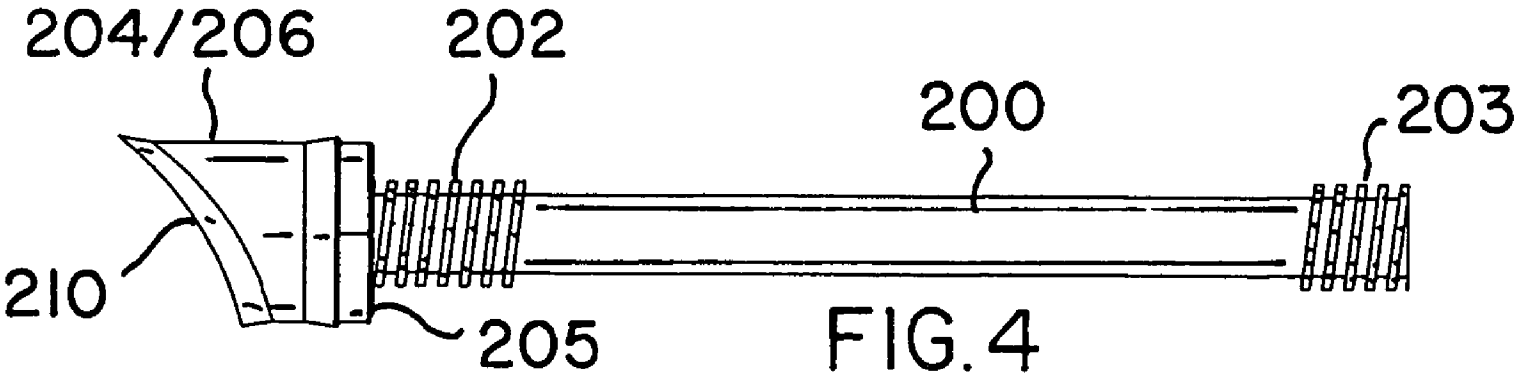
FIG. 4 is an axial plan view of the piston.
Figure 5:
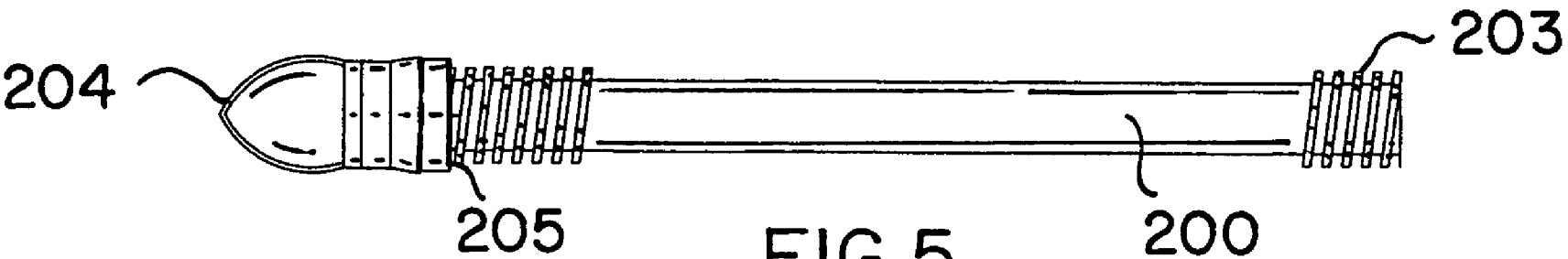
FIG. 5 is a view of the piston of FIG. 4 however rotated 90 degrees along the axis thereof.

In FIGS. 4 and 5 are shown a piston assembly 200 having a threaded rod 202, proportioned in diameter for press-fittable axial insertion through mouth 102 of said threadable insert 100 of FIG. 3 by slip-fittable axial insertion into said mouth of front end 104 thereof. In other words, through the use of axial slots 125 or other means interior diameter 106 of the threadable insert 100, including front end 104, thereof are proportioned for press-fittable insertion of proximal end 203 of piston assembly 200 (see FIG. 4) through the entire axial length thereof until a radial beginning 117 of splines 110 is reached. With further reference to FIG. 4, and the 90-degree axial rotational view of FIG. 5, it is noted that a preferably ellipsoidal piston 204 depends from a front end 205 of threaded rod 202. A cylindrical geometry 206 thereof is proportioned to hold a teardrop shaped column of cosmetic 302. A concave cross-section 210 of geometry preferably follows a concave curve 312 of mouth 304 of cartridge 300. See FIGS. 6 and 7. The invention however is also applicable to cosmetic columns 302 having a rectangular cross-section.

Figure 6:
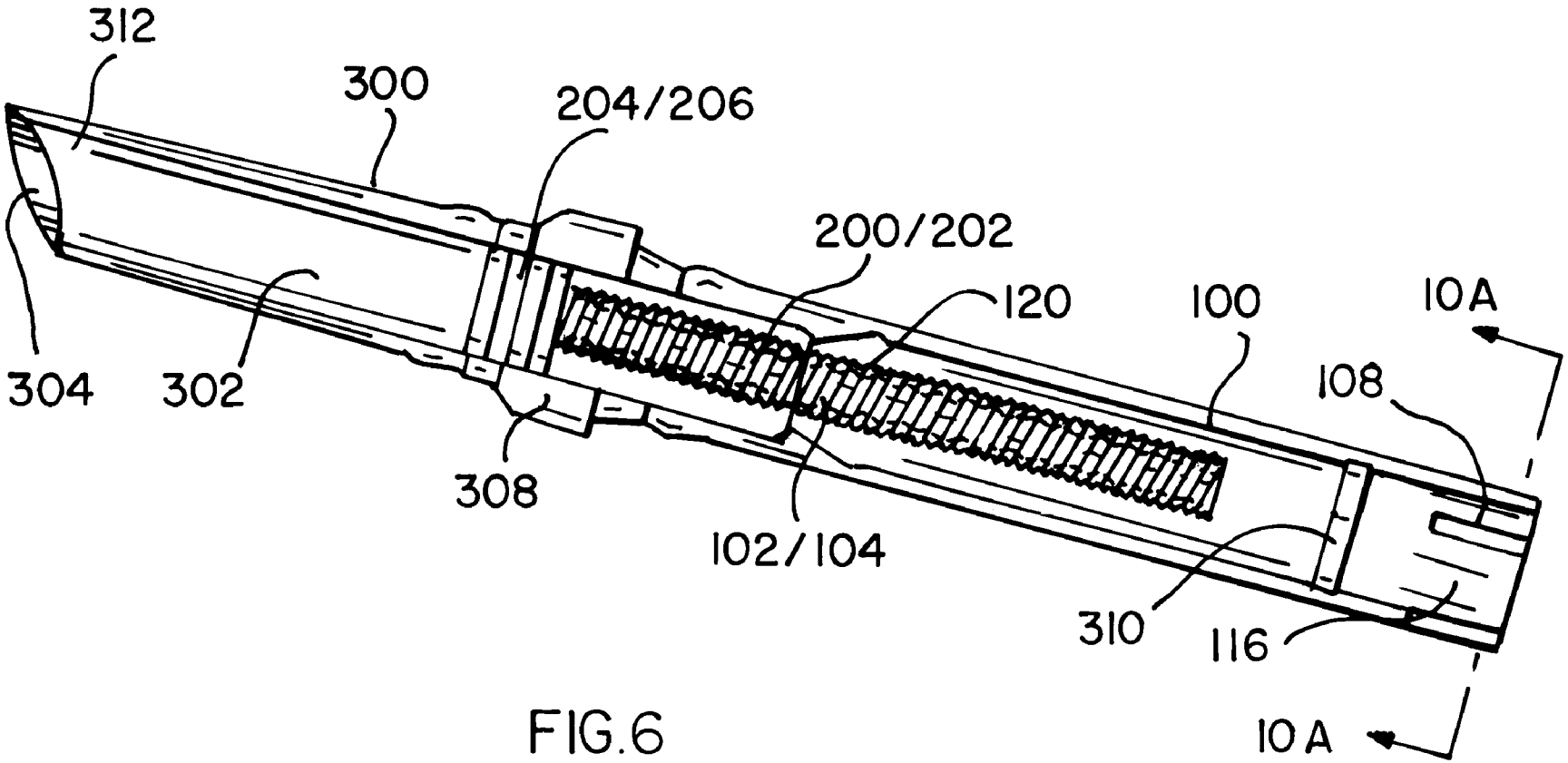
FIG. 6 is an assembly view of the invention showing insertion of the piston within the elongate threadable insert and, in turn, within the cartridge of the cosmetic applicator.

When proximal end 203 of piston assembly 200 is inserted through mouth 102 of threadable insert 100 of FIG. 3 and thereby into hollow internal portion 118 of insert 100, and into cartridge 300 one obtains the assembly of FIG. 6 in which piston assembly 200 is shown partially inserted into hollow threadable insert 100 in which piston and insert have been inserted within said cartridge 300. A proximal or rearview of the assembly of FIG. 6 is shown in perspective view in FIG. 7, as is more fully described below.

Figure 7:
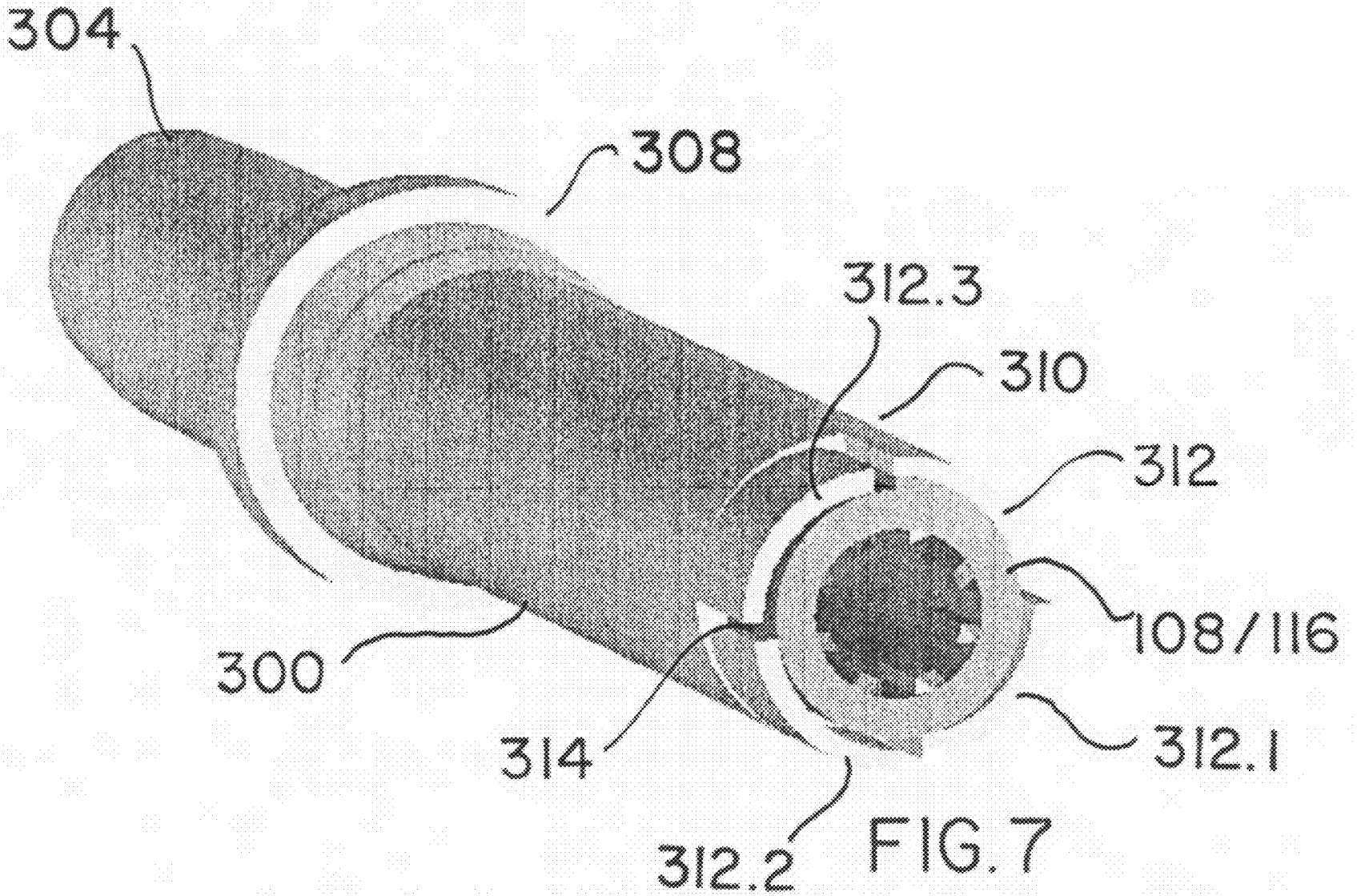
FIG. 7 is a rear view, similar to FIG. 6, however taken along an axial proximal direction thereof.
Figure 8:
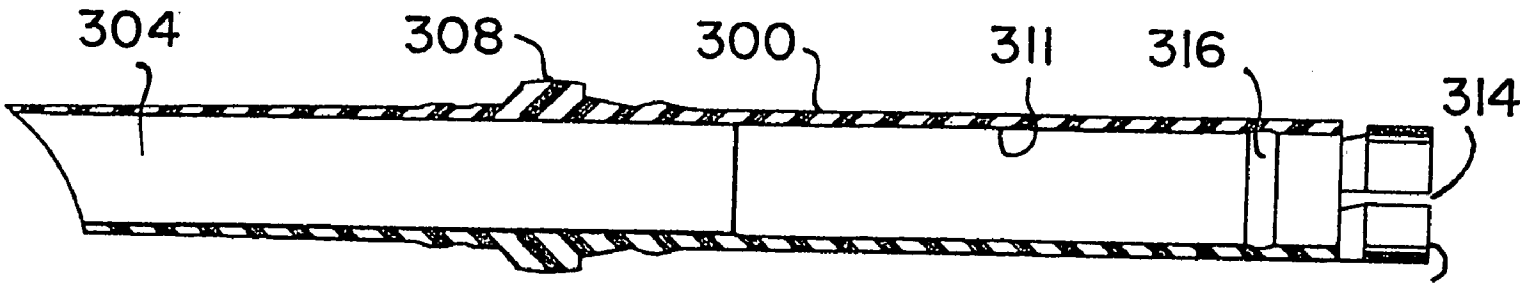
FIG. 8 is an axial cross-sectional view of the cartridge of the cosmetic applicator.
Figure 9:
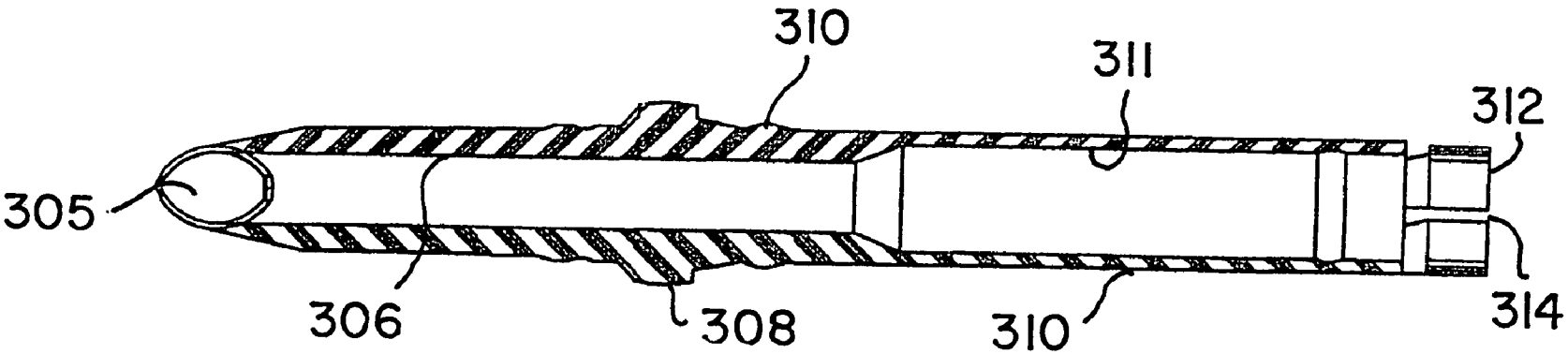
FIG. 9 is a view, similar to that of FIG. 8, however rotated axially by 90 degrees.

Shown in the cross-sectional views of FIGS. 8 and 9, in which FIG. 9 is axially rotated ninety degrees relative to FIG. 8, is said cartridge 300 of FIGS. 1 and 2, in which may be seen said front end 304, substantially ellipsoidal radial cross-section 306, and said annular collar 308. More particularly, cartridge 300 may be seen to include a non-ellipsoidal proximal portion 310 having an internal diameter proportioned for press-fittable receipt of said hollow threadable insert 100. See FIG. 6. At proximal-most portion of the cartridge 300 is provided longitudinal slots 314 which define the circumferential extent of resilient locking surfaces 312 which are circumferentially therebetween. It is noted that circumferential female groove 316 mates with said circumferential annular bead 119 to assure a stable relationship between inserts 100 and cartridge 300 after insert 100 is inserted thereinto. There may be provided upon the external surface of insert 100 and the internal surface of proximal portion 310 of cartridge 300 any number of complemental structures to assure a stable relation between insert 100 when inserted into cartridge 300, this including said annular ring 120 of threadable insert 100 (see FIG. 3). The relationship between insert 100 and 300, when insert 100 is inserted into cartridge 300 is illustrated in FIGS. 6 and 7 as well as FIGS. 9B, 9C, 14 and 17 described below.

Figures 9A, 9B, 9C:
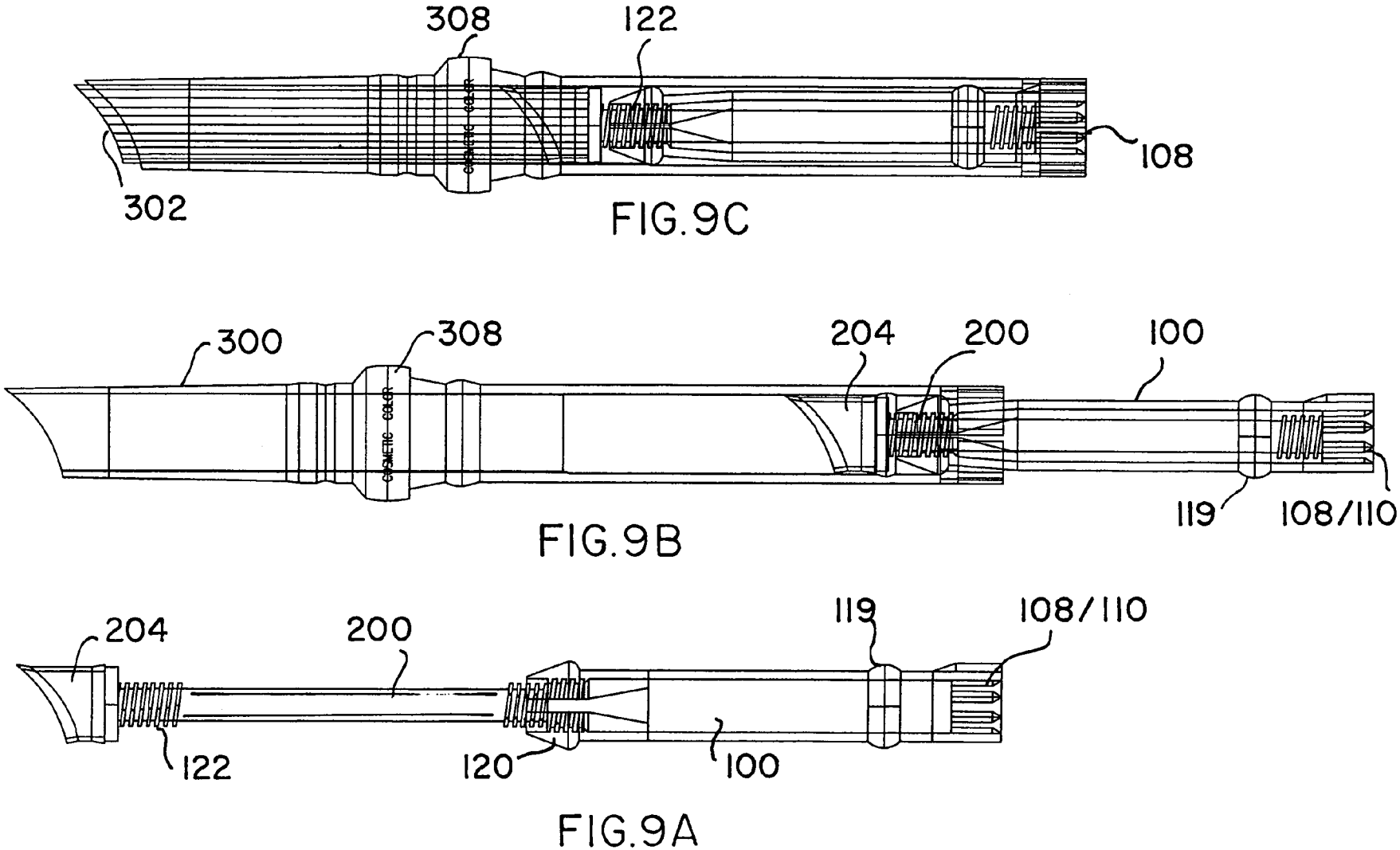
FIG. 9A is an elevational view of the proximal end of the piston rod slipped into the mouth of the insert.
FIG. 9B is an elevation view of the piston and insert within the proximal end of the cartridge.
FIG. 9C is a view similar to FIG. 9B, however showing the piston and insert advanced within the cartridge with the cosmetic column loaded into the cartridge.

In FIGS. 9A to 9C are shown sequential views of assembly of said piston, insert and cartridge into a functional structure.

Figure 10A:
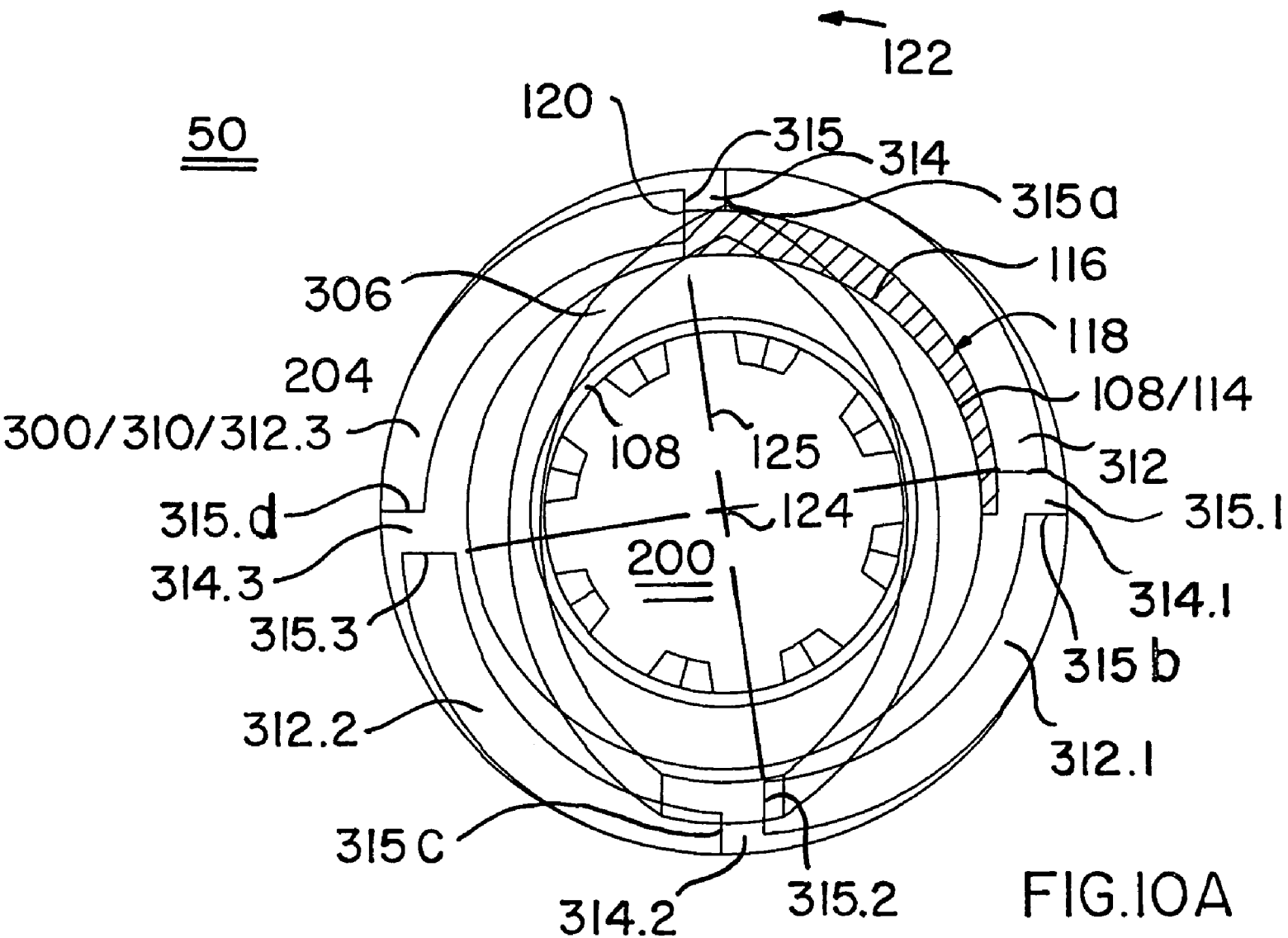

In FIGS. 1, 6, and 7 may be seen said slots 314 of cartridge 300 as well as segmented resilient four position locking surfaces 312 to 312.3. In the proximal axial end views of FIGS. 10, 10A, 11, 11A, 12 and 12A are shown the functional relationship between cam 116 of proximal radial end 114 of insert 100 and said locking surfaces 312 to 312.3 of cartridge 300 and cam 116 of proximal end 114 of insert 100. and said locking surface 312 to 312.3 of catridge 300. Therein, it is to be noted that FIG. 10A is an enlarged view of FIG. 10, FIG. 11A an enlarged view of FIG. 11, and FIG. 12A an enlarged view of FIG. 12. Accordingly, as may be noted with reference to FIGS. 10 and 10A there may, looking along axis 124 of insert 100 (see also FIG. 3) may be seen a proximal radial cross-sectional view of piston assembly 200 taken through line 10A-10A of FIG. 6. Radially outwardly therefrom, the substantially ellipsoidal cross-section of cartridge 300 is visible in mouth 304 thereof.

Therefrom, it is noted that proximal portion 310 of cartridge 300 includes a plurality of segmented resilient locking surfaces 312, 312.1, 312.2 and 312.3 which may seen in the enlarged view of FIG. 10A, which surfaces are separated by slots 314, each of which is characterized by a right radial end surface 315 and left end surface 315A, left edge surfaces 315A and right edge surface 315.1, and so forth. said proximal end 108 of threadable insert 100 is provided an integral cam 116, having an axial length approximately equal to that of one of said locking surfaces 312. As may be noted in the sequential views of FIGS. 10A, 11A and 12A, when cam 116 cannot be rotated to the left, that is, in counterclockwise direction 122 because the cam is forced to stop at the radial edge 315A of locking surface 312.3 of the cartridge 300. This represents a locked position of the system because each right edge 315*a* of each locking surface 312 is under pressure from inclined plane 118 of cam 116. Accordingly, threadable insert 100 cannot further rotate in direction 122, that is, to the left.

Figures 10, 11, 12:
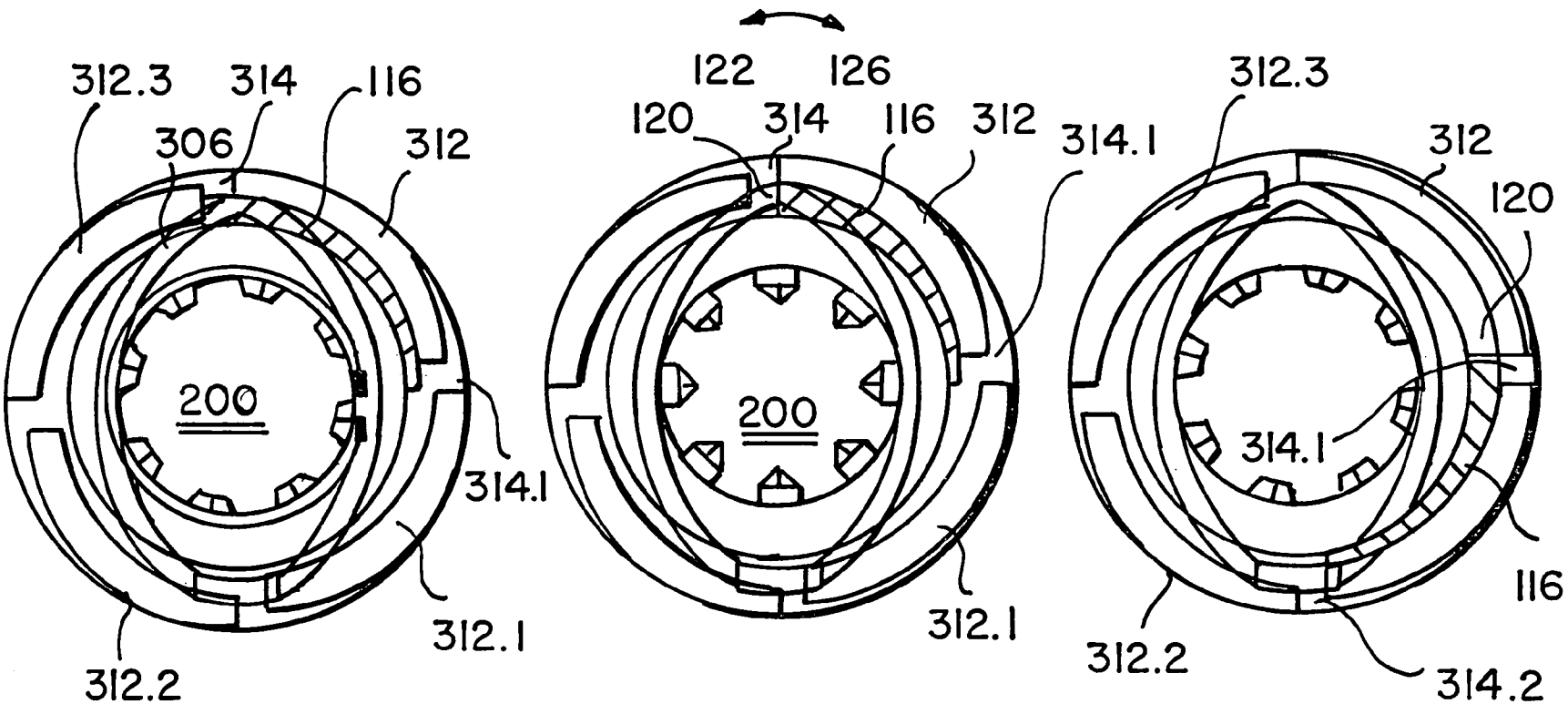
FIGS. 10 and 10A are axial cutaway views taken along Line 10A-10A of FIG. 6, showing the inventive camming function of locking system in a locked position between the cam of the hollow threadable insert and the locking system of the cartridge.
FIGS. 11 and 11A are sequential views relative to the views of FIGS. 10 and 10A showing cam is in a neutral position between the locked positions of FIGS. 10 and 12.
FIGS. 12 and 12A are sequential views relative to the views of FIGS. 11 and 11A, showing second locking position, including the maximum radial up-lift by the cam of the threaded insert.
Figure 11A:
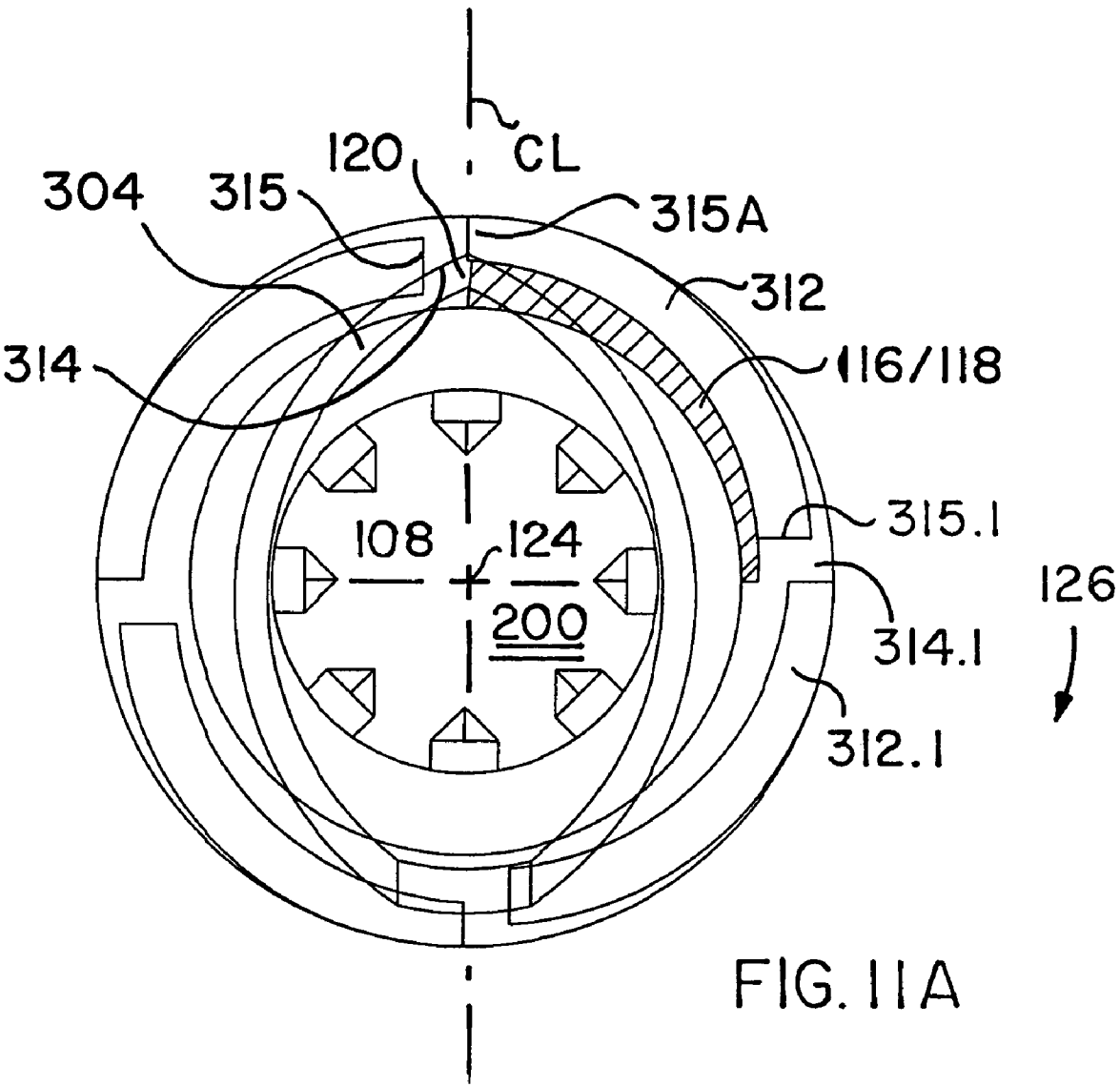

In FIGS. 11 and 11A, threaded insert 100 and its cam 116 is turned to the right (direction 126) relative to a top centerline CL, this being a neutral position of the system. Therein, the threadable insert 100 can turn only to the left and to the degree permitted the circumferential length of locking surfaces 312. In the four cam surface embodiment shown in FIGS. 10-12, the system may be turned to the right, only and only by ninety degree increments. As may be noted in FIG. 11A, radial edge 120 of inclined plane 118 of cam 116 are aligned with radial edge 315A of camming surface 312 which exists between slots 314 and 314.1 of cartridge 300. Accordingly, in the neutral position of FIGS. 11 and 11A, threaded insert 100 may move back and forth but only within the upper right quadrant shown in FIG. 11A.

Figure 12A:
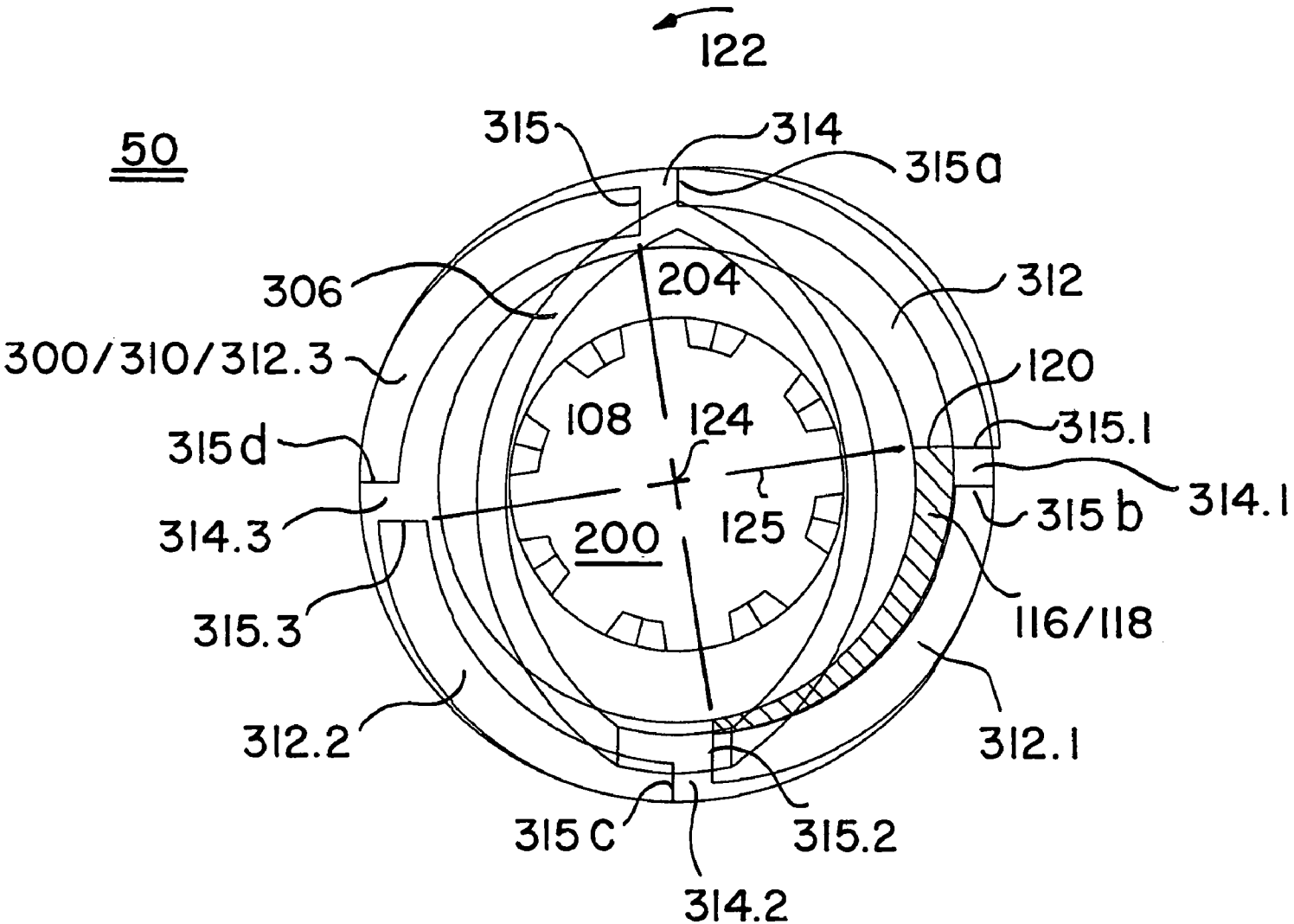

In FIGS. 12 and 12A, hollow threadable insert 100 and cam 116 are again turned to the right, that is, direction 126, wherein said cam lifts-up locking surface 312 at radial level to achieve a second locked position, located at the lower right quadrant of view of FIG. 12A. Accordingly, there exist four potential lock positions and four potential neutral positions in the operation of the present system, the neutral positions existing when radial edge 120 of the cam 116 is aligned with edges 315*a*, 315*a*.1, 315*a*.2 or 315*a*.3 of locking surfaces 312, 312.1, 312.2 or 312.3 respectively.

Figure 14:
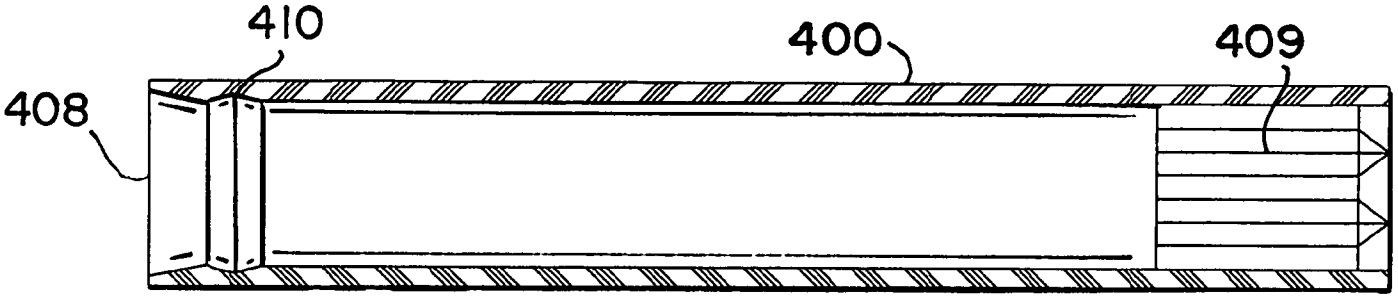
FIG. 14 is an axial cross-sectional view of the elongate hollow body portion of the applicator.
Figure 13:
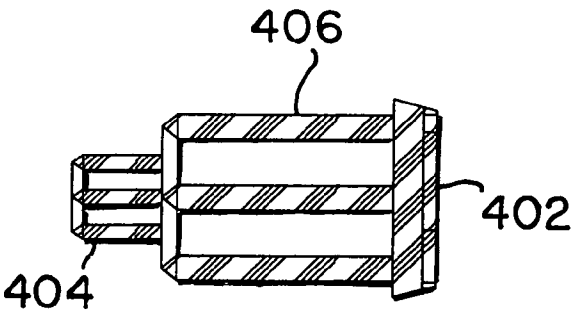
FIG. 13 is an axial cross-sectional view of a double spline end plug portion of the proximal hollow body of the applicator.
Figure 15:
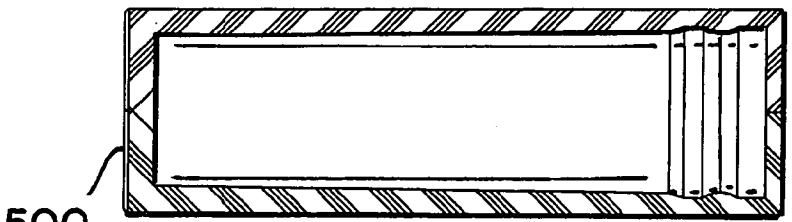
FIG. 15 is an axial cross-sectional view of the cap of the refill cartridge.
Figure 16:
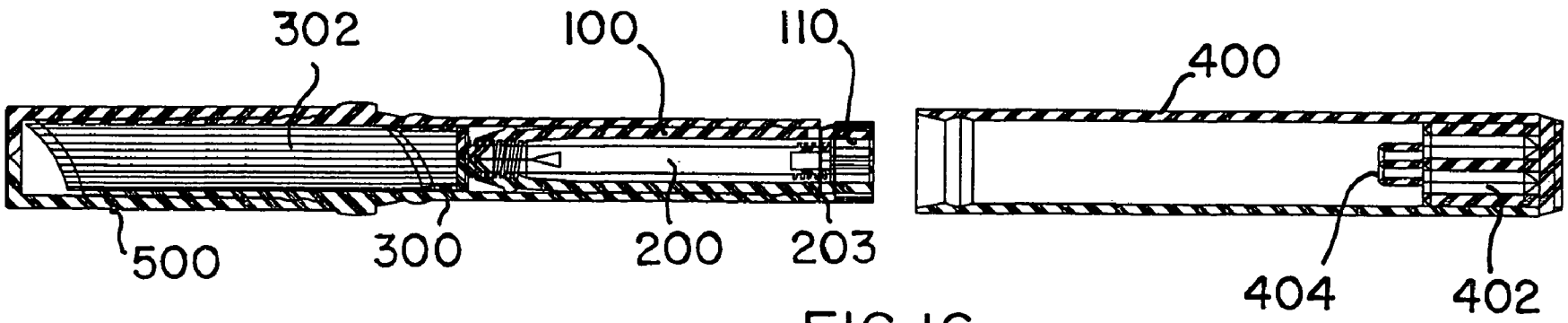
FIG. 16 is an exploded view showing the piston rod within the hollow threadable insert and, in turn, the piston threaded rod, threaded insert within the cartridge in which the cap is placed over the front portion of the cartridge.

With reference to FIG. 13, there is shown an end plug 402 which includes an inner plurality of splines 404 and outer plurality of splines 406. An end plug 402A may be integrally formed within a proximal hollow body 400 (see FIG. 14B) having a mouth 408A and inner splines 404A. That is, including locking surfaces 312 of refill cartridge 300 may be molded, permitting movable cam 116 of threaded insert 100 to move in and out. See FIG. 20. Inner plurality of splines 404 or 404A are proportioned for complemental receipt of female splines 110 of hollow threadable insert 100 (see FIG. 16) in which complete insertion of threadable insert 100 into spline 404 of plug 402 of body 400 is shown in FIGS. 14, 17, 18 and 19. The function of outer plurality of splines 406 of end plug 402 is to fit complementary within elongate female recesses 409 of elongate hollow body 400, such that upon turning, body 400 clockwise, for example by the thumb and fore finger of the right hand of a user of body 400, plug 406 will turn with the hollow body thus causing a clockwise rotation of plurality of splines 404. See FIGS. 13-16. Also shown in FIGS. 14 and 14A is mouth 408 and female annulus 410 that mates with male annulus 310 shown in FIGS. 1 and 9.

Figure 14A:
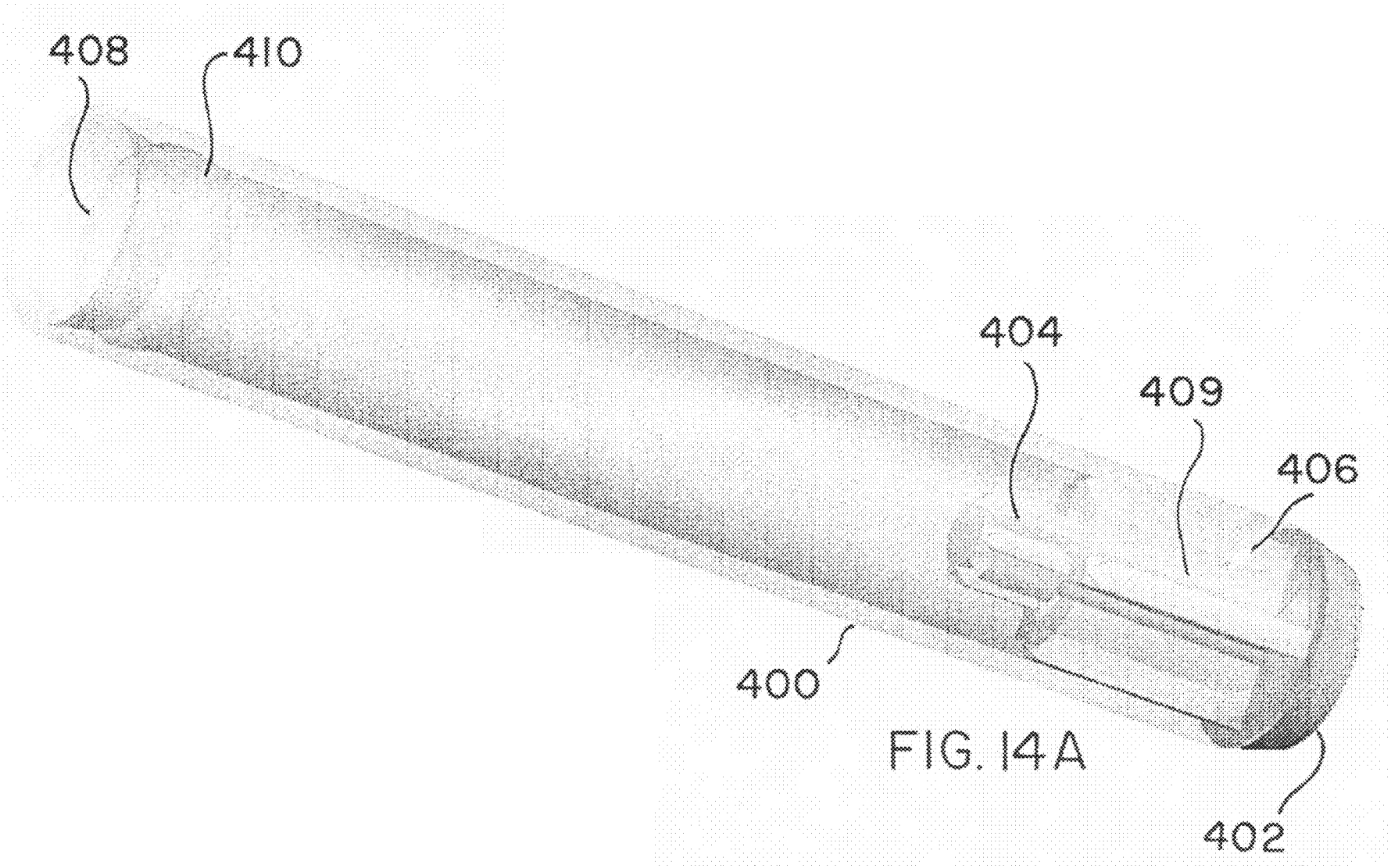
FIG. 14A is a perspective breakaway view showing the smaller spline and end plug inserted within the hollow body portion.
Figure 14B:
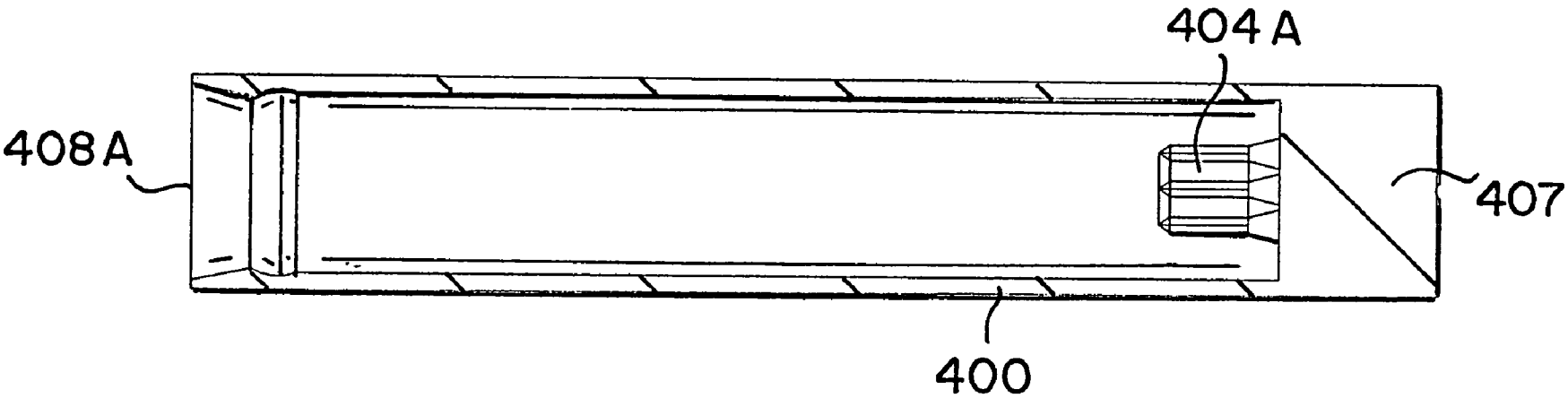
FIG. 14B is an axial cross-sectional view showing the end plug integrated into the hollow body portion.

In FIG. 14A, end plug 402 is shown inserted within body 400 to thus form the complete proximal hollow body assembly. It is however to be appreciated that plug 402 may be formed either separately or integrally within proximal end of body 400 to thereby yield an identical mechanical structure. In either method of construction of elongate proximal hollow body 400, inner plurality of splines 404 engage said circumferential plurality of splines 110 of proximal end 108 of hollow threadable insert 100 (see FIG. 3). The assembly of these parts within each other is shown in FIGS. 17-19, and 21. Resultingly, when elongate hollow body 400 is rotated, the same will induce the rotation of the entire threadable insert 100 and, therewith, the proximal end 108 thereof and, therewith, above-described cam 116. Thereby, as elongate hollow body 400 is held with one hand and cartridge 300 is held with the other hand, when the right hand is used to rotate elongate hollow body 400, with end plug 402, said cam 116 will rotate in the above-described manner relative to four position locking system of proximal end of said cartridge 300, thereby effectuating the above-described step wise locking function of cam 116 and said locking surfaces 312, 312.1, 312.2 and 312.3. See also FIG. 7.

Figure 17:
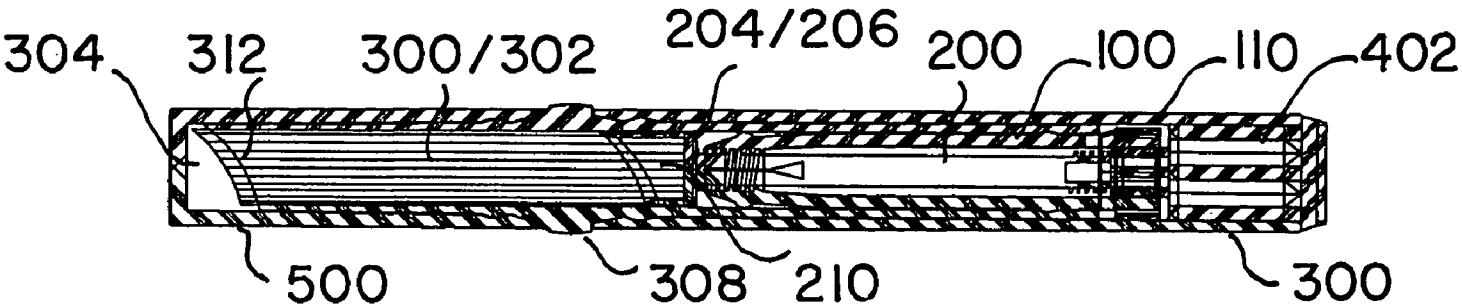
FIG. 17 is an axial cross-sectional assembly view of all parts of the present system.
Figure 18:
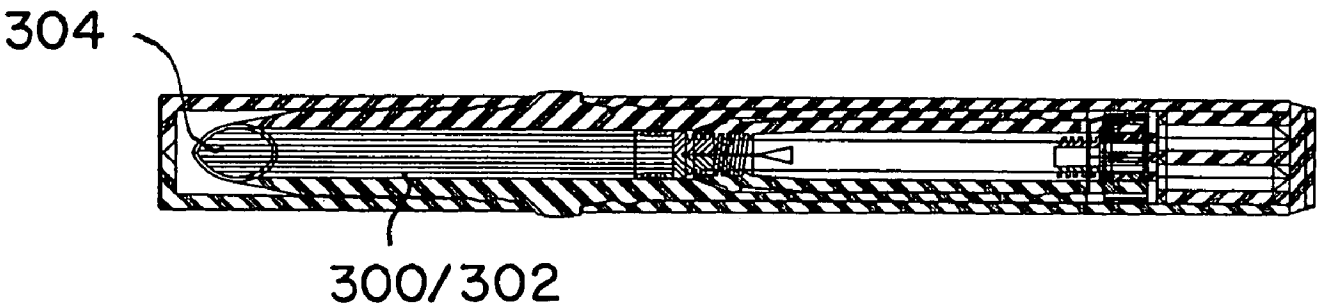
FIG. 18 is a view, similar to that of FIG. 17, however rotated 90 degrees along the axis of the applicator.
Figure 19:
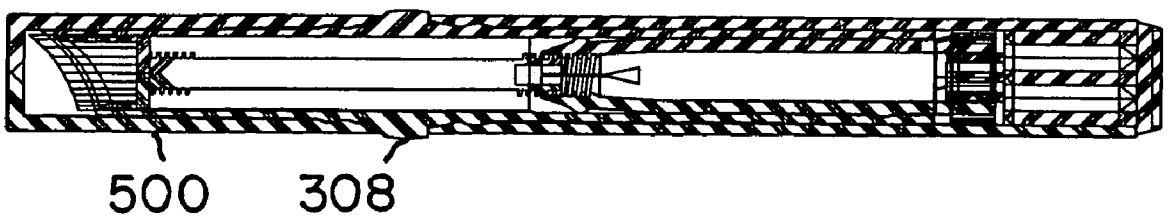
FIG. 19 is a view, similar to that of FIG. 17, however in which the cosmetic column of the applicator has been consumed by normal usage by the user.
Figure 20:
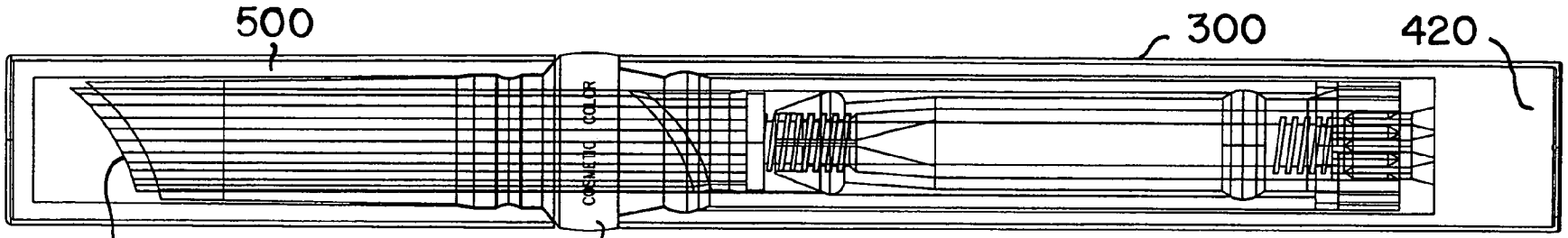
FIG. 20 is an elevational view of the assembled product with integrated end plug, otherwise similar to that of FIG. 17.
Figure 21:
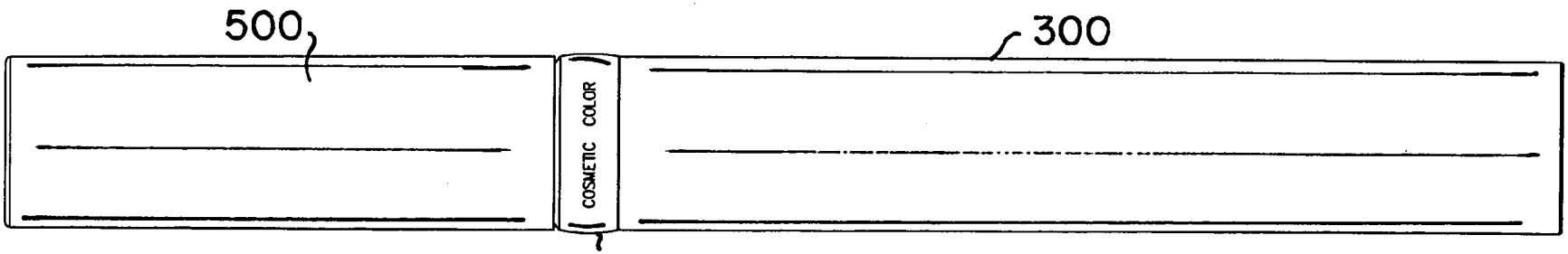
FIG. 21 is an external view of FIG. 20.
Figure 22:
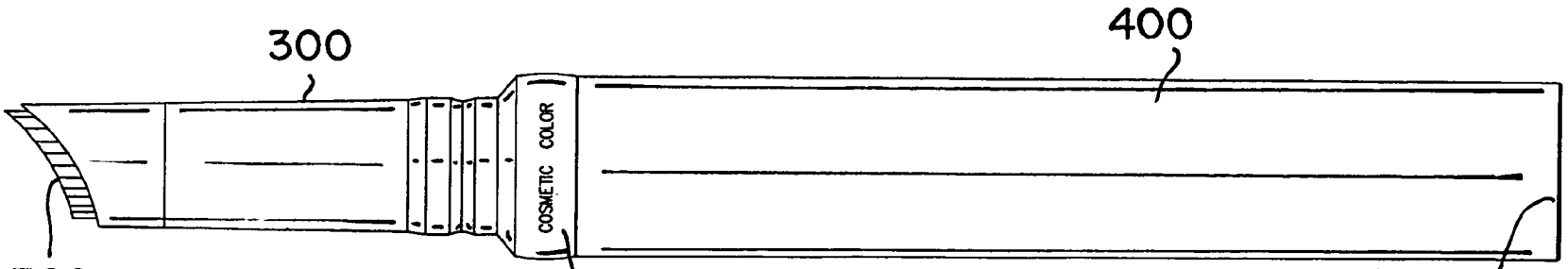
FIG. 22 is an elevational view of the complete product as it appears just prior to use, however without the cap placed thereon.
Figure 23:
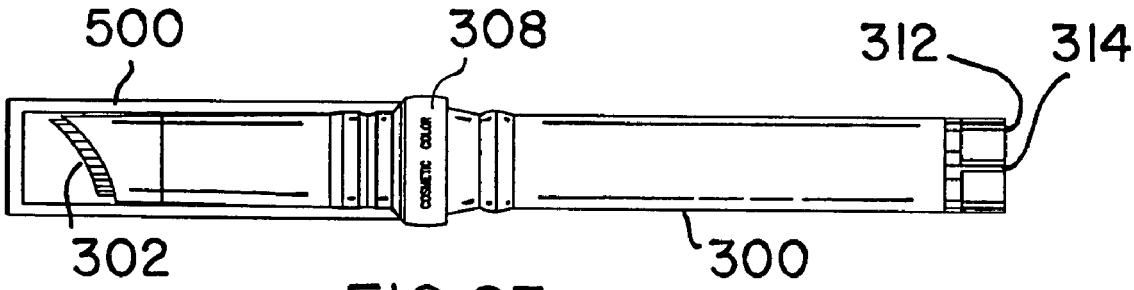
FIG. 23 is a view of the refill cartridge of FIG. 22, however in which a clear cap is placed thereon and in which the collar of the cartridge is provided with a color corresponding to the color of the cosmetic column in the cartridge.
Figure 24:
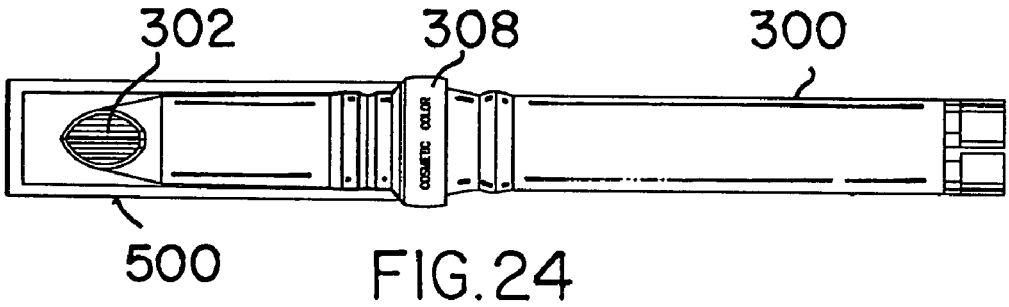
FIG. 24 is a view similar to that of FIG. 23, however axially rotated by 90 degrees.
Figure 25:
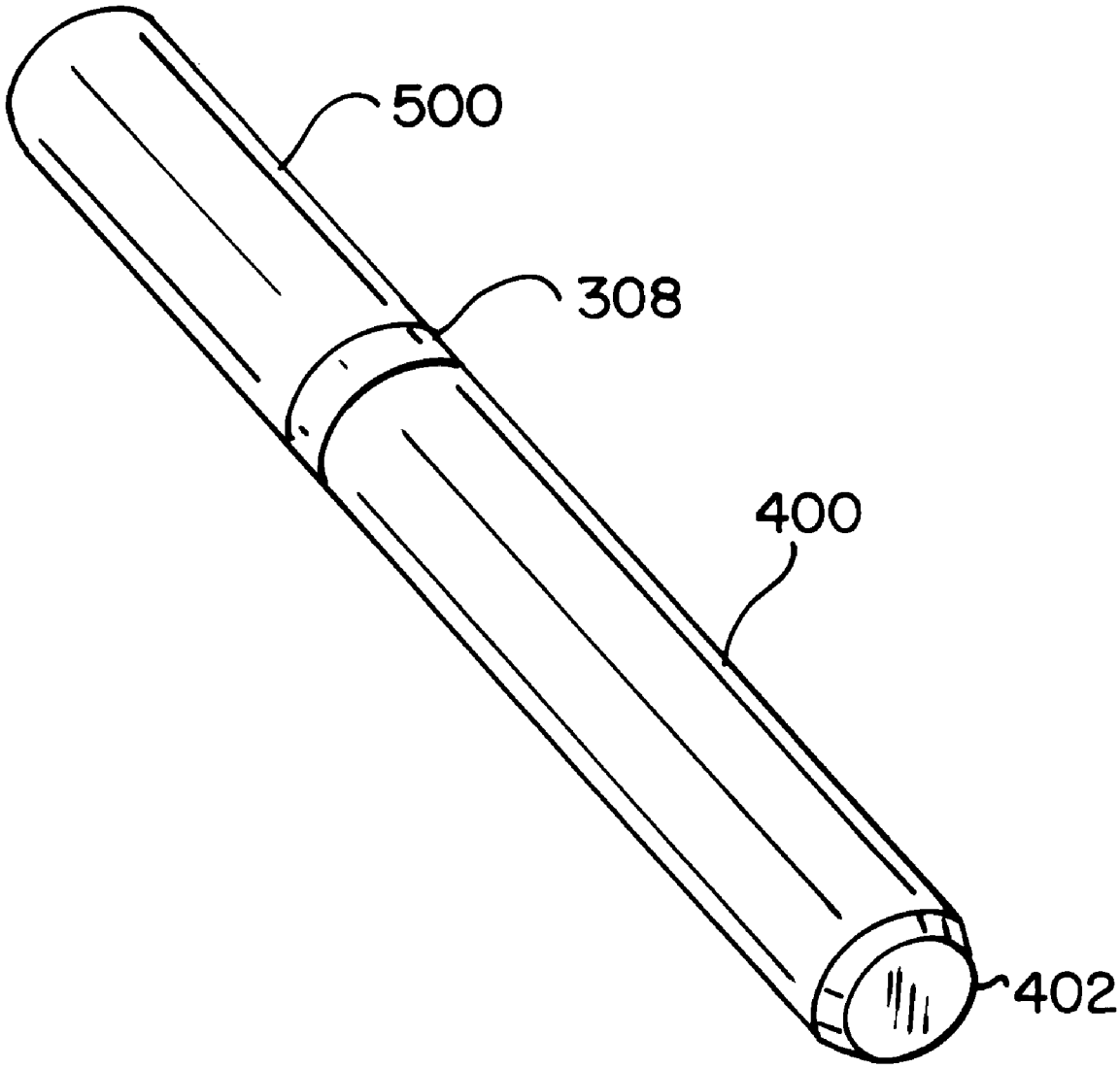

As may be noted, FIG. 18 is a 90-degree axial rotational view relative to the axial cross-sectional views of FIGS. 17 and 19, in which cosmetic column 302 is shown in its originally hot poured condition before use thereof has been initiated. In FIG. 19, the inventive cosmetic applicator is shown after cosmetic column 302 has been completely discharged or used. Also shown in FIGS. 15-21 is a cap 500 that is proportioned for press-fit engagement over front end of cartridge 300. As may be noted, cap 500 extends as far back as collar 308 of cartridge 300. The elevational view of FIG. 22 shows the assembled end product without the cap 500 thereon. In FIG. 20, it may be noted that a metal sleeve may be added or included over cap 500 and over body 400. In FIGS. 21 and 25 are shown the final product of FIGS. 20, 22, 23 and 24 with, however, the addition of cartridge 300 in which collar 308 is provided with a color reflective of the color of the column of cosmetic column 302 above-described.

It is noted that a metal sleeve 301 (see FIGS. 20-21) may be provided that locks over the forward part of the cartridge 300.

All plastic parts and refill cartridge 300 with cosmetic column 302 were left inside a heated chamber or car (sun heat) in excess of 100 degrees Fahrenheit the cosmetic column did not shrink, break, fall out, or change its teardrop shape, leaving of the complete assembly ready to use.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

The invention claimed is:

1. A cosmetic applicator, comprising:

(a) an elongate hollow threadable insert having a mouth situated at a front end thereof and an interior diameter defining, at a proximal end thereof, a circumferential plurality of elongate splines, said proximal end upon an exterior surface thereof including an integral partially circumferential cam terminating in a radial edge, said threadable insert having a direction of rotation about a longitudinal axis of said applicator, (b) a cartridge for receiving a column of cosmetic to be applied to the user, said cartridge including a front portion having a radial cross-section, an annular collar, and a proximal portion having a cylindrical internal diameter proportioned for press-fittable receipt of said threaded insert, said cam of said proximal end of said threadable insert engaging a plurality of segmented resilient locking surfaces of said proximal portion and defining a limit of rotation of said cam of said threadable insert relative to said cartridge;

(c) a piston having a threaded rod proportioned in diameter for push-fittable axial insertion through said threadable insert and for threadable engagement therewith when said insert is locked into said cartridge, said threaded rod proportioned in length to extend to said elongate splines within said interior diameter of said threadable insert, said piston integrally dependent from a front end of said threaded rod; and (d) an elongate proximal hollow body proportioned for press-fittable, rotational engagement about said cartridge.

2. The applicator as recited in claim 1, in which said front portion of said cartridge exhibits a substantially ellipsoidal radial cross-section terminating in a front output having a cross-sectional geometry of a teardrop.

3. The cosmetic applicator as recited in claim 2, in which said piston of said threaded rod defines a teardrop/shaped geometry at a front end thereof.

4. The cosmetic applicator as recited in claim 1, in which said segmented resilient locking surfaces of said proximal portion of said cartridge define axial slots between.

5. The cosmetic applicator as recited in claim 1, further comprising:

a cap proportioned for press-fit engagement over said front portion of said cartridge and for covering said cartridge to the cross-sectional location of said annular collar.

6. The system as recited in claim 1, in which said locking surfaces of said cartridge exhibit an axial inward bias in a direction of a longitudinal axis of the cosmetic applicator.

7. The cosmetic applicator as recited in claim 1, in which a head of said piston defines a geometry with a front cross-section of said cartridge.

8. The applicator as recited in claim 1, in which said front portion of said cartridge exhibits a cross-section terminating in a front output having a cross-sectional geometry of a rectangle.

9. The system as recited in claim 1, said proximal hollow body having a proximally-disposed end plug.

10. the system as recited in claim 9, a proximal end of said hollow body including a plurality of elongate female recesses proportioned for complemental engagement with said end plug.

* * * * *